United States Patent [19]

Reid

[11] 4,376,939

[45] Mar. 15, 1983

[54] POSITIVE LOCK FOR DEPLOYABLE WHIP ANTENNAS

[75] Inventor: James B. Reid, Phoenix, Ariz.

[73] Assignee: Motorola, Inc., Schaumburg, Ill.

[21] Appl. No.: 358,735

[22] Filed: Mar. 16, 1982

Related U.S. Application Data

[63] Continuation of Ser. No. 190,676, Sep. 25, 1980, abandoned.

[51] Int. Cl.[3] ..... H01Q 1/32

[52] U.S. Cl. ..... 343/715; 343/900

[58] Field of Search ..... 343/702, 711–715, 343/882, 900

[56] References Cited

U.S. PATENT DOCUMENTS 2,199,727 5/1940 Koss ..... 343/882

2,706,608 4/1955 Joseph ..... 343/882

3,946,317 3/1976 Ishimaru et al. ..... 343/702

*Primary Examiner*—David K. Moore

*Attorney, Agent, or Firm*—Lewis S. Gruber; Eugene A. Parsons

[57] ABSTRACT

A compression spring is compressed between an internal surface of a cavity within a base and the wide end of a plunger the shaft of which passes through the compression spring and out of a conically countersunk opening of the cavity. A tapered end of a ferrule is pivotally mounted to the external end of the plunger. The ferrule is fixed in a position perpendicular to the axis of the plunger so that when the ferrule is allowed to pivot toward alignment with the axis of the plunger, the plunger is drawn into the cavity by the action of the compression spring until the tapered end of the ferrule mates with the conically countersunk external opening of the cavity restricting motion of the ferrule that is lateral to the axis of the ferrule.

5 Claims, 2 Drawing Figures

POSITIVE LOCK FOR DEPLOYABLE WHIP ANTENNAS

This is a continuation, of application Ser. No. 190,676, filed on Oct. 25, 1980 and now abandoned.

BACKGROUND OF THE INVENTION

The present invention relates to positive locking devices and in particular to positive locks for deployable whip antennas.

It is inherent in a whip antenna that one end is fixed and the other end is free. A common way of fixing one end of a whip antenna is to place the end in a ferrule and attach the ferrule to a socket that is in turn screwed into a mounting or otherwise immovably attached to a base. Such a technique is employed in U.S. Pat. No. 4,134,120, where the antenna element comprises a relatively inflexible composite rod.

Where the antenna element must be alternately stowed in a coiled configuration and deployed in an erect configuration, a common solution has been to wind the antenna element or its support on a drum which is attached to the fixed end of the antenna element and which limits its motion when deployed. U.S. Pat. No. 3,253,799 reveals a motor-actuated reel to which is anchored and around which is wound a flexible cable. One end of the cable is welded to a rod which is attached to the centermost of a concentric collection of coaxial interlocking tubular antenna sections. When the cable is unwound, the antenna is extended to the limit of the tubular interconnections and the drum is locked in place by clutch action against a gear. When the cable is wound, the antenna is collapsed so that each tube section is substantially within the next larger tube section. To fix the end of the antenna in this way necessarily requires that a relatively large volume be provided for the reel and for the motor, a requirement that is generally infeasible in relatively small devices, such as an expendable RF transmitter or receiver, with which the antenna might be used.

In the case of a coilable, self-erecting antenna element, such as the one described in the copending application "SELF-ERECTING COMPOSITE ANTENNA STRUCTURE" Ser. No. 399076 filed July 16, 1982, assigned to common assignee, use of a fixed ferrule requires the provision of a relatively large amount of space for bending the antenna element from coaxial alignment with the ferrule to an alignment perpendicular to the axis of the ferrule in order to coil the element about the device to which it is attached. Likewise, use of a reel would require provision of a relatively large volume for the reel that would reduce the advantages of such an antenna in space-limited applications. Thus both the fixed ferrule and the clutched drum methods of locking the position of the fixed end of a whip antenna suffer from the disadvantage of requiring more volume than is desirable for use in devices where space is a critical factor.

SUMMARY OF THE INVENTION

Accordingly it is an object of the present invention to provide a new positive lock for deployable whip antennas.

A further object is to provide a positive lock for a deployable whip antenna which facilitates unattended deployment of an antenna from a tangential stowed position while coiled around the perimeter of a device to an axial position when erect.

Yet another object is to provide a positive lock for a deployable whip antenna which readily allows the stowage of the antenna by a simple manual operation.

This and other objects of the present invention will become apparent to those skilled in the art upon consideration of the accompanying specification, claims and drawings.

In order to attain the above-mentioned objects, the present invention comprises a compression spring compressed between an internal surface of a cavity within a base and a flange on a plunger, the shaft of which passes through the compression spring and out of a conically countersunk external opening of the cavity. A tapered end of a ferrule is pivotally mounted to the external end of the plunger. The ferrule is fixed in a position perpendicular to the axis of the plunger so that when the ferrule is allowed to pivot toward alignment with the axis of the plunger, the plunger is drawn into the cavity by the action of the compression spring until the tapered end of the ferrule mates with the conically countersunk opening of the cavity restricting motion of the ferrule in a direction lateral to the axis of the ferrule.

BRIEF DESCRIPTION OF THE DRAWINGS

Referring to the drawings in which like reference numerals indicate like structures.

DESCRIPTION OF THE PREFERRED EMBODIMENT

Figure 1:
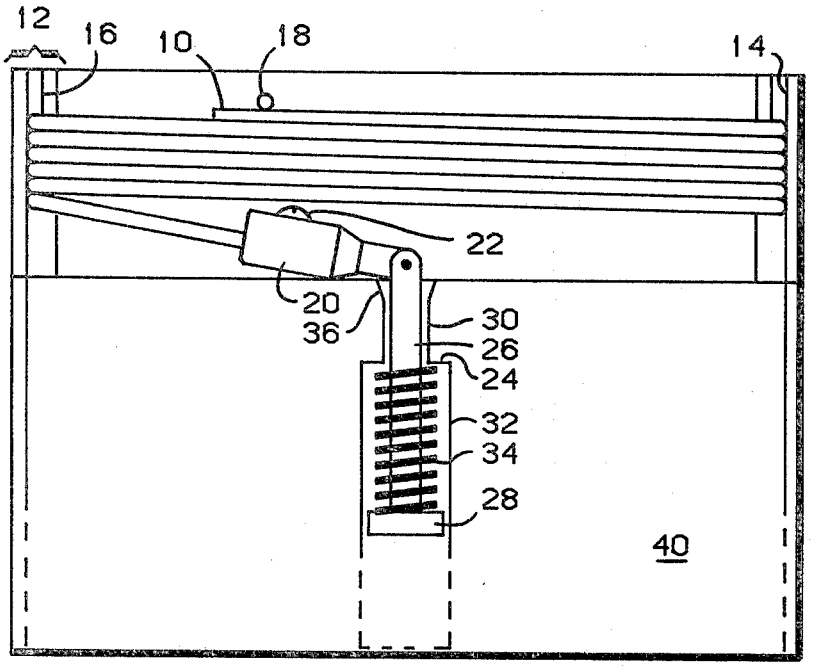
FIG. 1 is a side view with cutaway portions to show the present invention in place on the device to which it is attached to the stowed configuration.

In FIG. 1, an embodiment of the positive lock for deployable whip antennas is illustrated in conjunction with a coilable self-erecting antenna element as disclosed in the copending application "SELF-ERECTING COMPOSITE ANTENNA STRUCTURE", supra. As can be seen where the outer surface of base 40 is cut away, as in FIG. 1, antenna element 10 is coiled within base 40 between the inner wall 16 and the outer wall 14 of groove 12. Antenna element 10 is prevented from uncoiling by release pin 18 which is shown in cross section. One end of antenna element 10 is clamped within split ferrule 20 by the tightening action of set screw 22. It will be understood by those skilled in the art that antenna element 10 could be fixed within ferrule 20 by any of a number of means including the use of conductive adhesives for example. It will also be obvious to one skilled in the art that antenna element 10 may have to be electrically isolated from base 40 as in the preferred embodiment, for example, by the use of a dielectric ferrule. This then would allow the antenna to be electrically driven from or connected to electronics which may, for example, be a part of or be mounted within base 40.

Ferrule 20 is pivotally connected to the shaft of plunger 26. Plunger 26 (which acts as an energy transmission means) passes through conically countersunk opening 36, through the narrowed portion 30 of cavity 32, and through compression spring 34, before terminating in a wide flange 28 inside cavity 32. As shown in FIG. 1, cavity 32 is made narrower by an internal surface of base 40 at the end of spring 34 farthest from flange 28. Spring 34 is thus compressed between flange 28 and surface 24. The combined action of coiled antenna element 10 and release pin 18 prevents ferrule 20 from being pivoted to allow plunger 26 to be pulled into cavity 32 by the action of spring 34.

After release pin 18 is removed, antenna element 10 uncoils and erects itself. When the uncoiling process progresses to the segment of antenna element 10 closest to ferrule 20, the release of strain energy in the uncoiling process causes ferrule 20 to be pivoted toward alignment with the axis of plunger 26. At this point, the spring force of spring 34 is no longer opposed by the frictional force along the surface of coiled antenna element 10. Thus spring 34 extends itself, and pushes flange 28 away from surface 24. This causes the shaft of plunger 26 to be drawn entirely inside narrow portion 30 of cavity 32 so that the tapered portion of ferrule 20 is seated in conically countersunk opening 36 as can be better seen in FIG. 2. As will be clear to those skilled in the art, other techniques could be used to draw plunger 26 into cavity 32.

Figure 2:
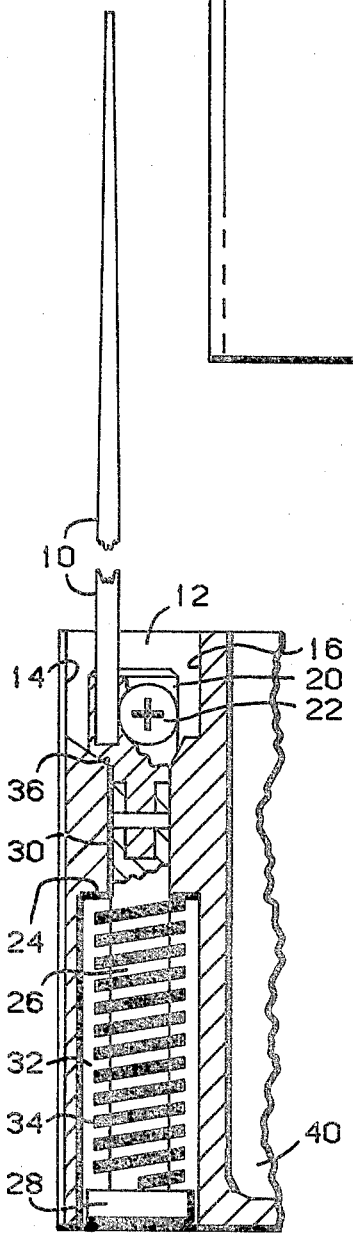
FIG. 2 is a frontal view of the present invention in cross section showing the invention in an erect configuration.

In FIG. 2, antenna element 10 is shown erect but is shown broken because of the scale of the drawing. Antenna element 10 is radially displaced from the axis of ferrule 20 toward outer wall 14 in a position as close to a tangential position on the perimeter of device 40 as possible so that the end of a stiff antenna element 10 need not be bent over a sharper radius. It would be obvious to one skilled in the art to select other positions for the ferrule for use with antenna elements composed of various materials or for use in non-antenna applications.

As can be seen in FIG. 2, the mating of the tapered end of ferrule 20 and conically countersunk opening 36 restricts lateral motion of ferrule 20. A bevel of about 15° to about 30° has been found sufficient to prevent lateral motion although it will be obvious that other degrees of taper might be employed. It will also be obvious to those skilled in the art that simply providing an untapered small end on a ferrule that fits tightly within an untapered opening would also work but would require more precise machining.

The present invention offers the further advantage that by pulling ferrule 20 out of its mating configuration and pivoting ferrule 20 out of alignment with the axis of plunger 26, antenna element 10 can be rewound about device 40 and pin 18 replaced to stow device when not in use.

While the present invention has been described in terms of a preferred embodiment, further modifications and improvments will occur to those skilled in the art. I desire it to be understood, therefore, that this invention is not limited to the particular form shown and I intend in the appended claims to cover all such modifications which do not depart from the spirit and scope of this invention as herein described.

What is claimed is:

1. A positive lock for deployable whip antennas comprising:

(a) a base having a cavity with at least one external opening, said cavity having an axis passing through said external opening;

(b) means for storing and releasing energy within said cavity;

(c) a plunger having a first end external to said cavity and a second end internal to said cavity, said plunger being responsive to said means for storing and releasing energy such that said first end of said plunger is pulled into said cavity when said means for storing and releasing energy releases energy;

(d) means for triggering release of energy from said means for storing and releasing energy; and, (e) a ferrule pivotally mounted on said first end of said plunger, said ferrule being capable of assuming at least a first position external to said cavity and out of alignment with said axis of said external opening and a second position at least in part within said cavity and in alignment with said axis of said cavity so that when said first end of said plunger is pulled into said cavity said ferrule is pulled from said first position external to said cavity and out of alignment with said axis of said external opening to said second position at least in part within said cavity and in alignment with said axis of said cavity so that motion of said ferrule laterial to said axis is restricted.

2. The positive lock for deployable whip antennas as recited in claim 1 wherein:

said base further comprises an internal surface projecting into said cavity;

said means for storing and releasing energy comprises a compression spring; and said second end of said plunger comprises a flange fixing said compression spring between said flange and said internal surface so that said compression spring is relatively compressed when said first end of said plunger is external to said cavity and so that said compression spring is relatively expanded when said first end is within said cavity.

3. The positive lock for deployable whip antennas as recited in claim 1 wherein:

said ferrule comprises a wide end wider than said external opening and a narrow end narrower than said external opening, said narrow end being shaped to match said external opening so that when said first end of said plunger is pulled within said cavity by release of energy by said means for storing and releasing energy, said narrow end of said ferrule is mated to said external opening so that motion of said ferrule is laterally restricted by encirclement of said narrow end by said external opening.

4. A method for fixing in place a deployable whip antenna having a base containing a cavity with at least one external opening and with an axis passing through the external opening, having means for storing and releasing energy, having means for triggering said means for storing and releasing energy, having a plunger with a first end and a second end, and having a ferrule pivotally connected to the first end of the plunger, comprising the steps of:

(a) triggerably loading the means for storing and releasing energy by pulling the ferrule entirely out of the cavity and pulling the first end of the plunger at least in part out of the cavity; and (b) pivoting the ferrule out of alignment with the axis of the cavity and setting the means for triggering said means for storing and releasing energy so that the ferrule is prevented from pivoting into alignment with the axis of the cavity.

5. A method for deploying a deployable whip antenna having a base containing a cavity with at least one external opening and with an axis passing through the external opening, having means for storing and releasing energy, having means for triggering said means for storing and releasing energy, having a plunger with a first end and a second end, and having a ferrule pivotally connected to the first end of the plunger, comprising steps of (a) releasing the means for triggering said means for storing and releasing energy; and (b) aligning the ferrule with the axis of the cavity so that at least part of the ferrule is pulled into the cavity by the means for storing and releasing energy such that lateral motion of the ferrule with respect to the axis is restricted.

* * * * *